US008635835B2

(12) United States Patent
Tomizawa et al.

(10) Patent No.: US 8,635,835 B2
(45) Date of Patent: Jan. 28, 2014

(54) HOLLOW MEMBER

(75) Inventors: Atsushi Tomizawa, Minoo (JP); Naoaki Shimada, Osaka (JP); Michitaka Yoshida, Amagasaki (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/186,663

(22) Filed: Jul. 20, 2011

(65) Prior Publication Data

US 2012/0013148 A1 Jan. 19, 2012

Related U.S. Application Data

(63) Continuation of application No. PCT/JP2010/050671, filed on Jan. 21, 2010.

(30) Foreign Application Priority Data

Jan. 21, 2009 (JP) ..... 2009-011163

(51) Int. Cl.
*E04C 3/00* (2006.01)
*F16L 19/00* (2006.01)

(52) U.S. Cl.
USPC ..... 52/843; 52/857; 138/DIG. 11

(58) Field of Classification Search
USPC ..... 52/843, 857; 138/177, DIG. 11; 428/592, 603; D25/126
See application file for complete search history.

(56) References Cited

U.S. PATENT DOCUMENTS 1,363,416 A * 12/1920 Hooker ..... 29/890.045
2,115,769 A * 5/1938 Harris ..... 126/91 A
2,771,276 A * 11/1956 Constance, Jr. et al. ..... 256/22
(Continued)

FOREIGN PATENT DOCUMENTS

| | | |
|---|---|---|
| JP | 63-188427 | 8/1988 |
| JP | 2816000 | 10/1998 |
| WO | 2006/093006 | 9/2006 |

OTHER PUBLICATIONS

Jidosha Gijutsu (Journal of Society of Automotive Engineers of Japan), vol. 57, No. 6, (2003), pp. 23-28.

*Primary Examiner* — Brian Glessner
*Assistant Examiner* — Joseph J Sadlon
(74) *Attorney, Agent, or Firm* — Clark & Brody

(57) ABSTRACT

A lightweight hollow member having excellent stiffness and impact properties and which is suitable for automotive parts due to having a high strength such as at least 780 MPa and a complicated shape is provided. A hollow member 11 has a hollow steel body 14. The body 14 is constituted by a single member at least in the lengthwise direction. The body 14 has a flat cross section having at least a portion with a maximum outer dimension $L_1$ and a portion with an outer dimension $L_2$ shorter than the maximum outer dimension $L_1$. The body 14 has a twisted portion in a portion of its length. The angle of intersection between an imaginary plane 15*a* including the portion having the maximum outer dimension $L_1$ in a first portion 15 present on one side of the body 14 in the lengthwise direction with the twisted portion 17 as a border and an imaginary plane 16*a* including the portion with the maximum outer dimension $L_1$ in a second portion 16 present on the other side in the lengthwise direction of the body 14 with the twisted portion 17 as a border is at least 4 degrees. The twisted portion 17 has a tensile strength of at least 780 MPa.

4 Claims, 6 Drawing Sheets

(56) References Cited

U.S. PATENT DOCUMENTS

| | | | | | |
|---|---|---|---|---|---|
| 2,909,361 | A * | 10/1959 | Dotson | 256/21 |
| 3,293,894 | A * | 12/1966 | Edgecombe et al. | 72/42 |
| 3,810,302 | A * | 5/1974 | Broers et al. | 29/600 |
| D248,463 | S * | 7/1978 | Barnes | D12/194 |
| 5,413,872 | A * | 5/1995 | Faigle | 428/603 |
| 6,325,431 | B1 * | 12/2001 | Ito | 293/102 |
| 6,349,521 | B1 * | 2/2002 | McKeon et al. | 293/102 |
| 6,684,909 | B2 * | 2/2004 | Ijima | 138/121 |
| 6,821,638 | B2 * | 11/2004 | Obeshaw | 428/593 |
| 7,041,218 | B1 * | 5/2006 | Liles | 210/512.1 |
| D586,208 | S * | 2/2009 | Evans | D9/432 |
| 2005/0241714 | A1 * | 11/2005 | Barnhouse et al. | 138/106 |
| 2006/0101890 | A1 * | 5/2006 | Chung | 72/371 |
| 2007/0017588 | A1 * | 1/2007 | Wobben | 138/37 |
| 2007/0039282 | A1 * | 2/2007 | Holl et al. | 52/720.1 |
| 2009/0260312 | A1 * | 10/2009 | Lee | 52/562 |

* cited by examiner

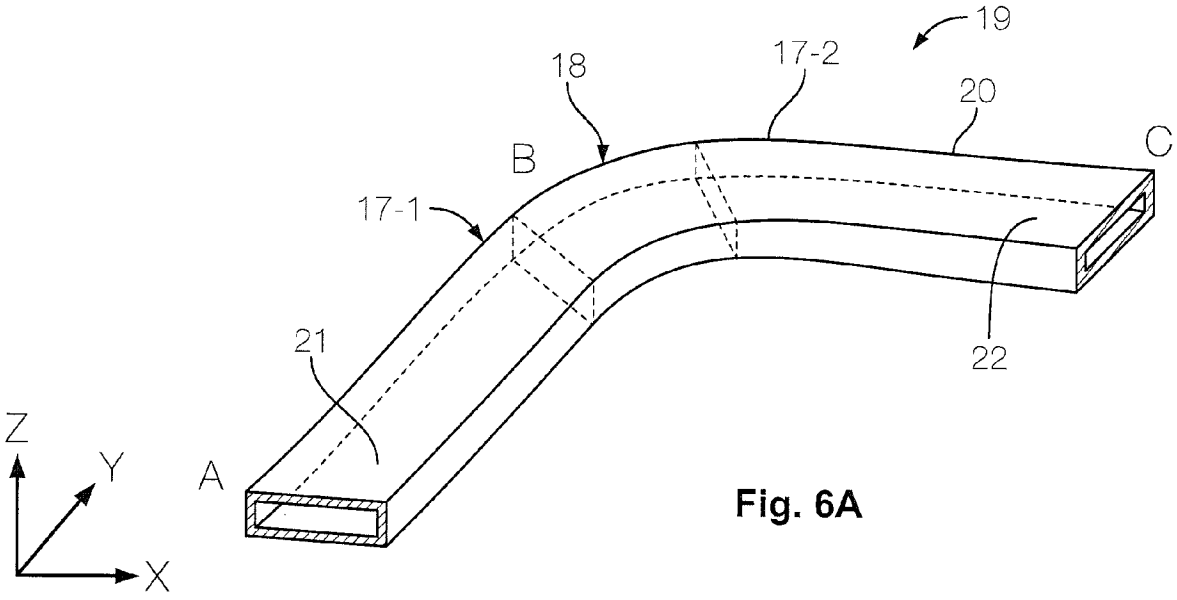
Fig. 6A
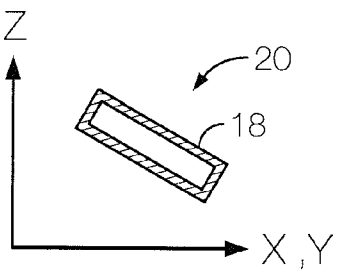
Fig. 6B
Fig. 6C
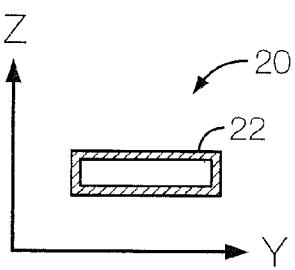
Fig. 6D

HOLLOW MEMBER

TECHNICAL FIELD

This invention relates to a hollow member. Specifically, the present invention relates to a lightweight hollow member having excellent stiffness and impact properties.

BACKGROUND ART

Strength members, reinforcing members, and structural members made of metal are used in automobiles and various types of machines. These members are required to have a high strength, a light weight, and a small size. From in the past, these members have been manufactured by working methods such as welding of press-formed parts, and punching or forging of thick plates. However, it is extremely difficult to further decrease the weight and size of members manufactured by these manufacturing methods. For example, when manufacturing welded parts by partially overlapping two panels formed by press working and welding them, it is necessary to form portions of excess thickness referred to as flanges on the edges of the panels, and as a result, the weight of the welded parts unavoidably increases by an amount corresponding to the excess thickness.

A working method referred to as hydroforming (see, for example, Non-patent Document 1) forms a tube into a complicated shape by introducing a working fluid at a high pressure into the interior of a pipe which is a material to be worked disposed inside a mold and carrying out deformation by expanding the pipe so that the outer surface of the pipe conforms to the inner surface of the mold. Parts having a complicated shape are integrally formed by hydroforming without the need to form flanges. In recent years, hydroforming has been actively applied to automotive parts with the objective of decreasing the weight of automotive parts.

Hydroforming is a type of cold working. Therefore, forming a material to be worked having a high strength such as at least 780 MPa into an automotive part having a complicated shape is difficult due to inadequate ductility of the material to be worked. As hydroforming generally requires three manufacturing steps, i.e., bending, preforming, and hydroforming, it is relatively complicated. Furthermore, a hydroforming apparatus is large and relatively expensive.

The present applicant disclosed a working apparatus in Patent Document 1. FIG. 7 is an explanatory view schematically showing this working apparatus 0.

The working apparatus 0 manufactures a bent member using a metal material 1 as a material to be worked by the following steps.

(a) A support means 2 supports the metal material 1 so that it can move in its axial direction.

(b) A feed device 3 feeds the metal member 1 which is supported by the support means 2 from the upstream side to the downstream side while the metal member 1 undergoes bending on the downstream side of the support means 2.

(c) Bending is carried out in the following manner. An induction heating coil 5 disposed downstream of the support means 2 locally, rapidly heats the metal member 1 to a temperature range in which quench hardening is possible. A cooling device 6 (such as a water cooling device) disposed immediately downstream of the induction heating coil 5 rapidly cools the metal member 1. A movable roller die 4 has at least one set of roll pairs 4*a* which can support the metal member 1 while feeding it. The movable roller die 4 is disposed downstream of the cooling device 6. By varying its position two-dimensionally or three-dimensionally, the movable roller die imparts a bending moment to the heated portion of the metal member 1.

Namely, a bent member is manufactured by the working apparatus 0 through the following steps.

(I) An elongated metal material 1 which has a hollow closed cross-sectional shape and is constituted by a single piece in the lengthwise direction is worked by a pair of rolls to form an elongated metal intermediate member having a flat, hollow, closed cross-sectional shape with a pair of opposing longer sides.

(II) The feed device 3 performs relative feeding of the intermediate member in its lengthwise direction.

(III) The support means 2 supports the intermediate member being fed at a first position.

(IV) The induction heating coil 5 locally heats the intermediate member being fed at a second position downstream of the first position in the feed direction of the intermediate member.

(V) The cooling device 6 cools the heated portion of the intermediate member being fed at a third position downstream of the second position in the feed direction of the intermediate member.

(VI) A bending moment is applied to the heated portion of the intermediate member by two-dimensionally or three-dimensionally varying the position of the movable roller die 4 which supports the intermediate member being fed in a region downstream of the third position in the feed direction of the intermediate member.

The working apparatus 0 can perform shaping of a one piece automotive part having a high strength such as at least 780 MPa and a complicated shape by simple steps using relatively inexpensive forming equipment. In this manner, a bent member having a high stiffness is manufactured by the working apparatus 0.

PRIOR ART DOCUMENTS

Patent Document

Patent Document 1: WO 2006/093006

Non-Patent Documents

Non-Patent Document 1: Jidosha Gijutsu (Journal of Society of Automotive Engineers of Japan), Vol. 57, No. 6 (2003), pages 23-28

SUMMARY OF THE INVENTION

Problem which the Invention is to Solve

There is an increasing demand for a lightweight member which has not only a high strength and a complicated shape but also a high stiffness and excellent impact properties for use as strength members, reinforcing members, and structural members for automotive parts. Therefore, further improvements in the properties of a bent member manufactured by the working apparatus 0 are required.

Means for Solving the Problem

The present invention is a hollow member having a hollow body made of metal and preferably of steel characterized by having the following features.

(Feature 1) The body is formed as a single piece at least in its lengthwise direction.

(Feature 2) The body has a flat cross section having at least a portion having a maximum outer dimension and a portion having an outer dimension shorter than the maximum outer dimension.

(Feature 3) The body has a twisted portion in a portion of its length.

(Feature 4) The angle of intersection between an imaginary plane including the portion having the maximum outer dimension in a first portion present on a first side in the lengthwise direction of the body with the twisted portion as a border and an imaginary plane including the portion having the maximum outer dimension in a second portion present on the other side in the lengthwise direction of the body with the twisted portion as a border is not zero degrees.

(Feature 5) The twisted portion has a tensile strength of at least 780 MPa.

In the present invention, the body preferably has at least one bent portion.

In the present invention, the ratio of the maximum outer dimension to the shorter outer dimension is preferably at least 1.2 and more preferably at least 1.5.

In the present invention, the angle of intersection between the two imaginary planes is preferably at least 4 degrees and more preferably at least 5 degrees.

In the present invention, the body preferably has quench hardened portions formed in portions of the length and/or the circumference of the body.

In the present invention, at least the twisted portion preferably has a residual stress of at most +150 MPa. In the present invention, at least the twisted portion more preferably has a residual stress of at most +50 MPa. In the present invention, still more preferably substantially the entire part of the twisted portion has a compressive residual stress. In this description, with respect to residual stress, a positive value indicates a tensile residual stress and a negative value indicates a compressive residual stress.

In the present invention, a hollow member according to the present invention is preferably used as a strength member, a reinforcing member, or a structural member for an automobile.

Effects of the Invention

According to the present invention, a lightweight hollow member which has excellent stiffness and impact resistance and which is suitable for use in automotive parts due to having a tensile strength of at least 780 MPa, for example, and a complicated shape is provided.

BRIEF EXPLANATION OF THE DRAWINGS

FIGS. 6A-D are explanatory views showing a hollow member having a twisted portion and a bent portion.

FIG. 7 is an explanatory view schematically showing a working apparatus which the present applicant previously disclosed in Patent Document 1.

| Explanation of Symbols | |
|---|---|
| 0 | working apparatus |
| 1 | metal material |
| 2 | support means |
| 3 | feed device |
| 4 | movable roller die |
| 5 | induction heating coil |
| 6 | cooling device |
| 11-13, 19 | hollow member |
| 14, 20 | body |
| 15 | first portion |
| 15a | imaginary plane |
| 16 | second portion |
| 16a | imaginary plane |
| 17 | twisted portion |
| 17-1 | first twisted portion |
| 17-2 | second twisted portion |
| 18 | bent portion |
| 21, 22 | first portion |

EMBODIMENTS OF THE INVENTION

The present invention will be explained while referring to the attached drawings. In the following explanation, an example will be given of the case in which the body of a hollow member has a rectangular cross section. However, the present invention is not limited to this case, and the present invention can be similarly applied to the case in which the body has a flat cross section such as an elliptical or oval cross section having at least a portion with a maximum outer dimension $L_1$ and a portion with an outer dimension $L_2$ which is shorter than the maximum outer dimension $L_1$.

Figure 1A:
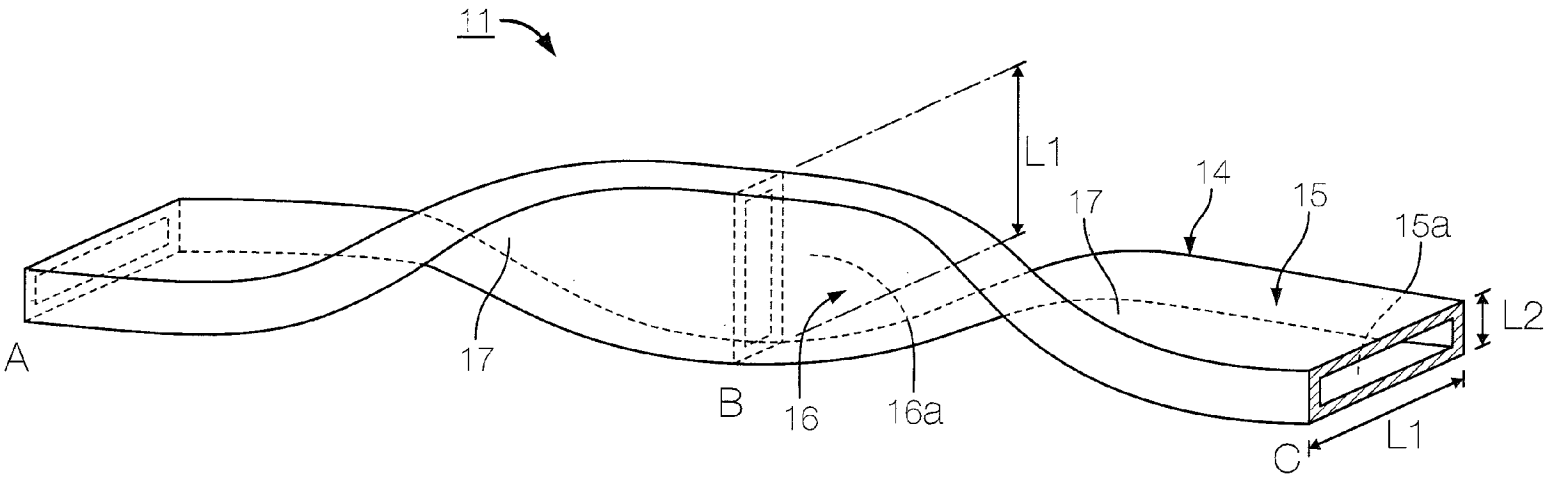
FIGS. 1A-C are explanatory views showing an example of a hollow member according to the present invention.
Figure 1C:
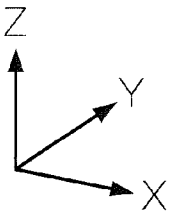
Figure 1C:
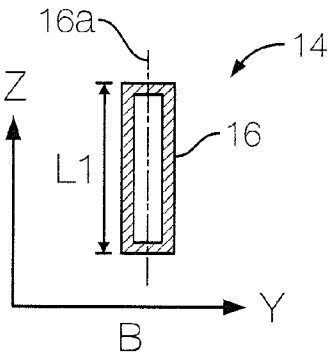
Figure 1B:
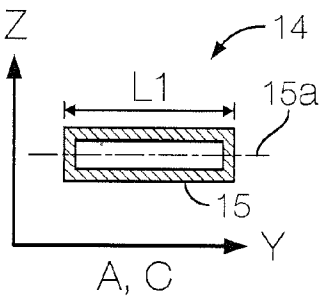
Figure 2:
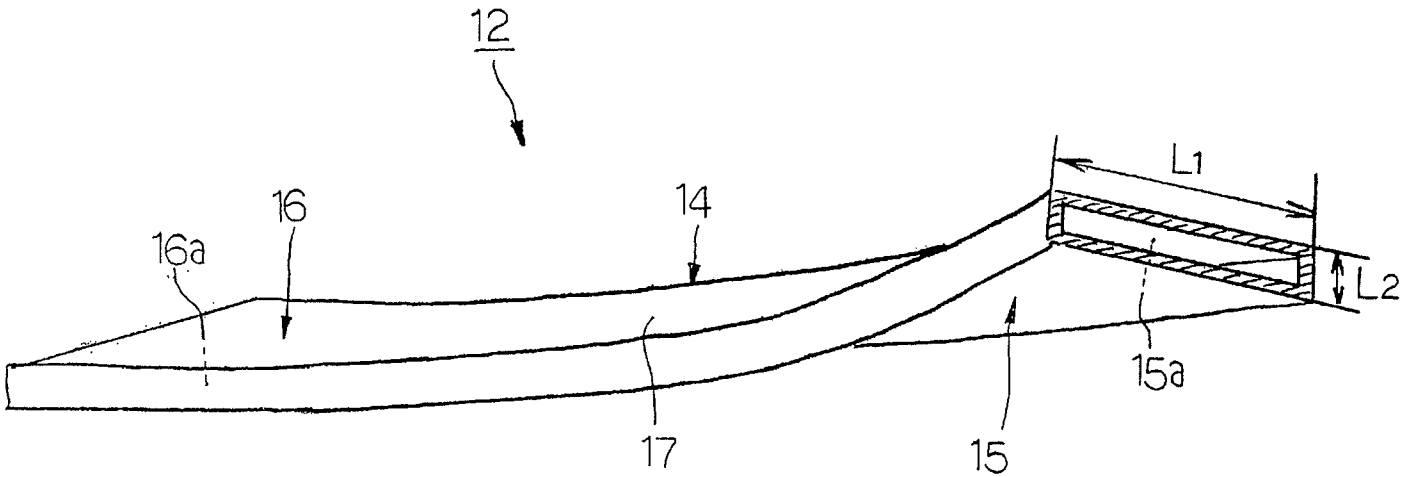
FIG. 2 is an explanatory view showing another example of a hollow member according to the present invention.
Figure 3A:
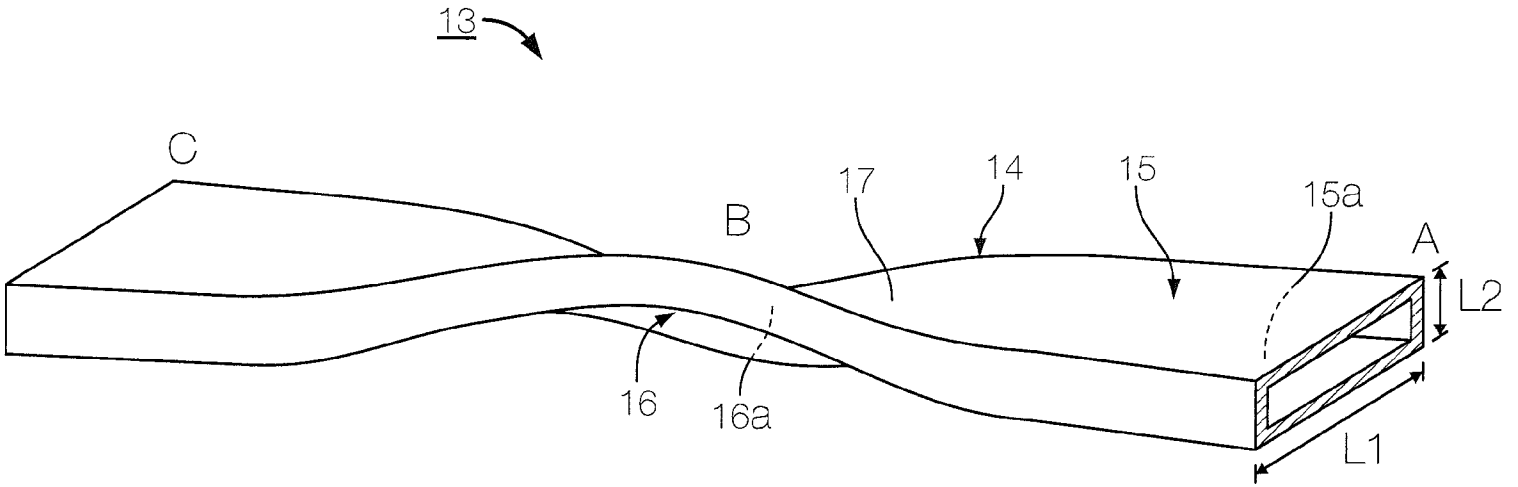
FIGS. 3A-C are explanatory views showing yet another example of a hollow member according to the present invention.
Figure 3C:
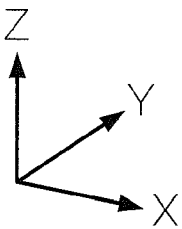
Figure 3C:
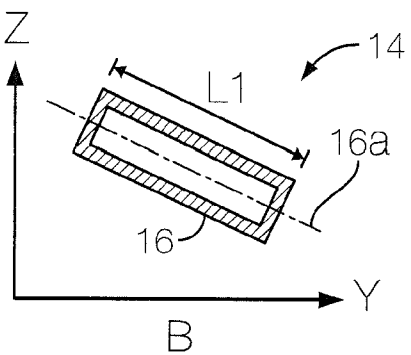
Figure 3B:
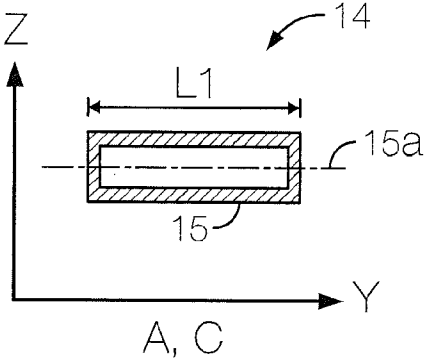

FIGS. 1A-C are explanatory views showing one example of a hollow member 11 according to the present invention. FIG. 2 is an explanatory view showing another example of a hollow member 12 according to the present invention. FIGS. 3A-C are explanatory views showing yet another example of a hollow member 13 according to the present invention.

The hollow members 11-13 each have a hollow body 14 made of metal (steel in this example).

The body 14 is constituted by a single unitary member at least in the lengthwise direction. Therefore, the body 14 does not have joints such as welds or the like formed in a direction crossing the lengthwise direction.

The body 14 has a flat cross section. The flat cross section has at least a portion with a maximum outer dimension $L_1$ and a portion with an outer dimension $L_2$ which is shorter than the maximum outer dimension $L_1$.

None of the hollow members 11-13 has a reinforcing member such as a reinforcement on the interior of the body 14. In this manner, each of the hollow members 11-13 has an extremely simple structure. The hollow members 11-13 are each light in weight.

The body 14 has a twisted portion 17 in a portion of its length. The body 14 has a first portion 15 which is present on one side in the lengthwise direction of the body 14 taking the twisted portion 17 as a border. The body 14 also has a second portion 16 present on the other side in the lengthwise direction of the body 14 taking the twisted portion 17 as a border.

The angle of intersection between an imaginary plane 15*a* including a portion having the maximum outer dimension $L_1$ in the first portion 15 and an imaginary plane 16*a* including a portion having the maximum outer dimension $L_1$ in the second portion 16 (referred to below as the angle of intersection) is not zero degrees. Furthermore, the twisted portion has a tensile strength of at least 780 MPa.

The reason why the hollow members 11-13 have a twisted portion 17 will be explained. In general, a commonly used index representative of the bending stiffness EI around the x-axis of a hollow member with a rectangular cross section is the second moment of area $I_x$. If Young's modulus is E, the width of the hollow member is b, its height is h, its wall thickness is t, and its aspect ratio is k, then b=kh.

Here, the second moment of area $I_{\theta x}$ when the cross section of the hollow member is twisted by an angle θ (theta) is given by the following equations.

$$I_{\theta x}=(1/2)(I_x+I_y)+(1/2)(I_x-I_y)\cos 2\theta$$

$$I_x=(1/12)\{bh^3-(b-2t)(h-2t)^3\}$$

$$I_y=(1/12)\{hb^3-(h-2t)(b-2t)^3\}$$

Figure 4:
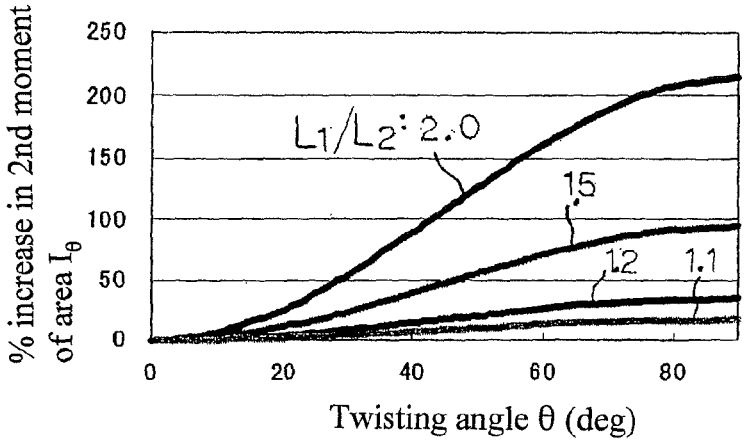
FIG. 4 is a graph showing the results of the calculation of the rate of increase of the second moment of area of a hollow member having a shape obtained by twisting a rectangular cross section with an outer circumference of 100 mm, a wall thickness of 2 mm, and an aspect ratio k of 1.1, 1.2, 1.5, or 2.0 by an angle θ (theta).

FIG. 4 is a graph showing the results of calculation using the above equations of the rate of increase in the second moment of area of a hollow member having a shape obtained by twisting a rectangular cross section having an outer circumference of 100 mm, a wall thickness of 2 mm, and an aspect ratio k of 1.1, 1.2, 1.5, or 2.0 by an angle θ (theta).

As shown by the graph in FIG. 4, the larger is the aspect ratio, namely, the greater is the degree of flatness, the larger is the increase in the bending stiffness when a twisting angle is imparted.

Figure 5:
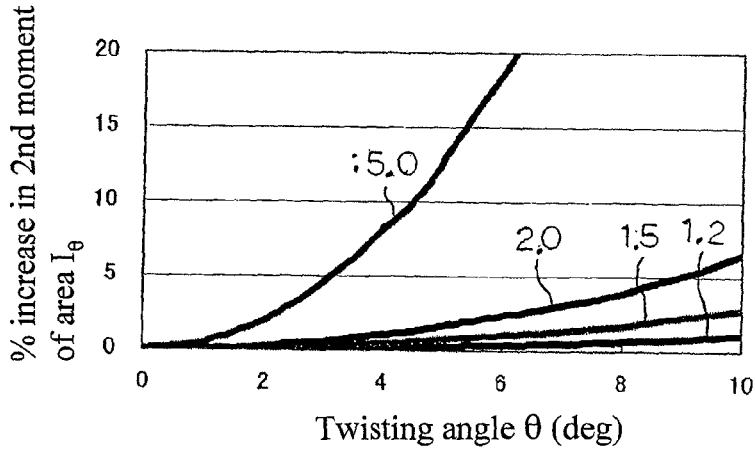
FIG. 5 is a graph showing the results of calculation of the rate of increase of the second moment of area of a hollow member having a shape obtained by twisting a rectangular cross section with a circumference of 100 mm, a wall thickness of 2 mm, and an aspect ratio k of 1.2, 1.5, 2.0. or 5.0 by an angle θ (theta).
Figure 5:
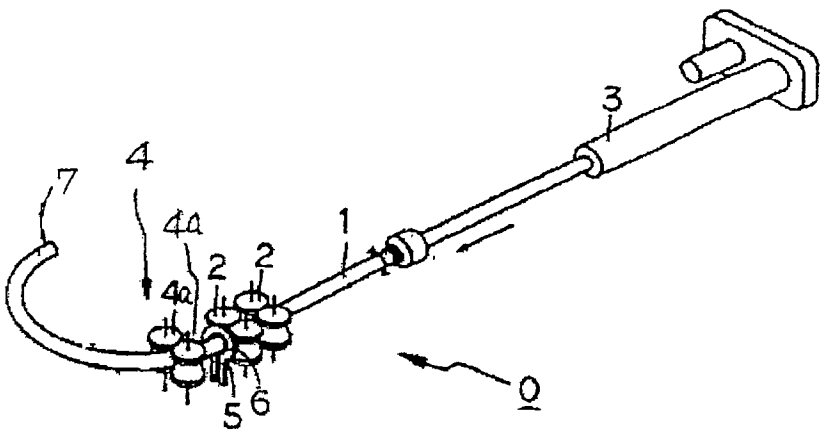

FIG. 5 is a graph showing the results of calculation using the above equations of the rate of increase of the second moment of area of a hollow member having a shape obtained by twisting a rectangular cross section with an outer circumference of 100 mm, a wall thickness of 2 mm, and an aspect ratio k of 1.2, 1.5, 2.0, or 5.0 by an angle θ (theta).

As shown in FIG. 5, the bending stiffness markedly increases when imparting an angle of intersection of at least 4 degrees and preferably at least 5 degrees.

The hollow members 11-13 each have an increased stiffness due to having a twisted portion 17.

From the results shown in the graphs of FIGS. 4 and 5, the value of (the maximum outer dimension $L_1$)/(the shorter outer dimension $L_2$) ratio of the hollow members 11-13 is preferably at least 1.2 and more preferably at least 1.5.

A single twisted portion 17 may be formed in the lengthwise direction of a hollow member 12 as shown in FIG. 2, or two twisted portions may be provided in the lengthwise direction of a hollow member 11 or 13 as shown in FIGS. 1 and 3, or three or more may be provided.

The hollow members 11-13 can be easily manufactured by a working apparatus which is constituted by partial modifying the working apparatus 0 shown in FIG. 7. Namely, the rolls which constitute the support means 2 and the movable roller die 4 of the working apparatus 0 are replaced by grooved rolls which can support the outer surface of hollow members 11-13, and a moving mechanism which three-dimensionally moves the position of the movable roller die 4 is additionally provided.

The hollow members 11-13 which are supported by the support means 2 so as to be movable in their lengthwise direction are fed by the feed device 3 from the upstream side to the downstream side. Next, the hollow members 11-13 are locally rapidly heated by the induction heating coil 5 downstream of the support means 2 to a temperature range in which quench hardening is possible. Next, the hollow members 11-13 are cooled by the cooling device 6.

The movable roller die 4 has at least one set of roll pairs 4*a* which can support the hollow members 11-13 while feeding them. A twisted portion 17 can be formed in the heated portion of the hollow members 11-13 by three-dimensionally varying the position of the movable roller die 4.

Instead of the support means 2, the feed device 3, and the movable roller die 4 of this working apparatus, feeding and support of the hollow members 11-13 can be carried out by using a fixture which is held by at least one articulated general purpose robot. Namely, by (a) producing relative movement of the hollow members 11-13 in their lengthwise direction with respect to the induction heating coil 5 and the cooling device 6, (b) supporting the hollow members 11-13 on either side of the portion being heated by an industrial robot, for example, and (c) three-dimensionally moving the position of one or both sides of the hollow members 11-13 on either side of the portion being heated by operating an industrial robot supporting one or both sides, a twisted portion 17 can be formed in the heated portion of the hollow members 11-13 without using a support means 2, a feed device 3, and a movable roller die 4.

By setting the heating temperature of the hollow members 11-13 by the induction heating coil 5 to a temperature at which quench hardening is possible and suitably setting the cooling rate of the hollow members 11-13 by the cooling device 6, quench hardened portions can be locally formed in the lengthwise direction of the body 14 of the hollow members 11-13 and/or in the circumferential direction of the body. By suitably setting the locations in which quench hardened portions are formed, various mechanical properties of the hollow members 11-13 can be adjusted, whereby it is possible to provide hollow members 11-13 which adequately satisfy the properties demanded of automotive parts, for example.

In order to prevent a decrease in the dimensional accuracy of the hollow members 11-13 which are passed through the movable roller die 4 due to their weight, a deformation preventing device is preferably disposed on the downstream side of the movable roller die 4 in this working apparatus. By positioning the hollow members 11-13 which have already been processed using the deformation preventing device in the region downstream of the movable roller die 4, deformation of the hollow members 11-13 and a decrease in dimensional accuracy thereof can be prevented with certainty. A deformation preventing device need not be provided.

Examples of a deformation preventing device are (a) a device which supports and guides the front end of the hollow members 11-13 which passed through the movable roller die 4, (b) a deformation preventing table which prevents deformation due to the weight on the hollow members 11-13 by having the hollow members 11-13 which passed through the movable roller die 4 disposed thereon, and (c) a known articulated robot which supports a portion of the hollow members 11-13 which passed through the roller die 4.

It is not possible to provide a twisted portion by cold working in hollow member which has been known in the art and which has a hollow metal body with a flat cross section and a tensile strength of at least 780 MPa because the hollow member has a high resistance to deformation. In contrast, the hollow members 11-13 can be manufactured by hot working using a working apparatus obtained by only slightly modifying a portion of working apparatus 0. Therefore, a twisted portion 17 can be formed in the body 14 extremely easily and with certainty.

Because this working apparatus 0 utilizes quench hardening to form the twisted portion 17, the tensile strength of the twisted portion 17 can be easily increased to at least 780 MPa.

In addition, this twisted portion 17 has excellent fatigue properties for the following reasons.

In general, when manufacturing a product by carrying out twisting of a hollow member in a cold state, a relatively large residual stress develops in the product. A tensile residual stress in the axial direction of the product develops in the surface of the inner periphery of the twisted portion. In addition, a compressive residual stress in the axial direction of the product develop in the surface of the outer periphery of the twisted portion. The residual stresses which develop may reach 30-40% of the yield stress.

A hollow member having a high strength such as 780 MPa or 980 MPa has poor ductility, so twisting can only be carried out on a product having a twisted portion with an extremely large bending radius. Even by a conservative estimate, there is a high probability of a residual stress of at least +200 MPa (a tensile residual stress) developing in the surface of the product. As is well known, if a tensile residual stress develops in the surface of a product, the fatigue properties when the product is repeatedly deformed are greatly decreased.

At the present time, there is no means for manufacturing a product by performing twisting in a cold state of a hollow member having a high strength such as 780 MPa, 980 MPa, or even 1200 MPa. As such, there are no published documents which disclose the measured values of the residual stress in these products. Even if it is assumed that a hollow member having a high strength can undergo twisting in a cold state, an extremely large tensile residual stress will unavoidably develop in the twisted portion. Furthermore, if a high tensile residual stress develops in a hollow member having a high strength of at least 1200 MPa, the danger of delayed fracture increases. Such a product cannot be used as an automotive part.

In contrast, a twisted portion 17 formed by working apparatus 0 is formed by twisting in a hot state. A high tensile residual stress which develops due to twisting in a cold state does not develop in the twisted portion 17.

Table 1 shows the results of measuring by the x-ray stress measurement method the residual stress (in MPa) in the surface in the axial direction of a product obtained by twisting a hollow rectangular member having a wall thickness of 1.8 mm, a height of 40 mm, and a width of 50 mm made from a boron-containing steel with a C content of 0.2 mass % using working apparatus 0 with bending deformation of 600 mm and a twisting angle per unit length of 0.2 degrees per mm. Table 2 shows the results of measurement of the residual stress in the surface in the circumferential direction of this product.

The angles in Tables 1 and 2 are the angles at the measurement position in the circumferential direction when the angle is 0 degrees at a position at the center of the upper surface having a width of 50 mm. The x-ray measurement apparatus used for measurement of residual stress was a model MXP-3 manufactured by MAC Science Corporation (current name: Bruker-AXS).

TABLE 1

| 0 degrees | 90 degrees | 180 degrees | 270 degrees |
|---|---|---|---|
| −194 | −210 | −224 | −217 |
| −170 | −243 | −172 | −76 |
| −68 | −50 | −24 | −148 |

TABLE 2

| 0 degrees | 90 degrees | 180 degrees | 270 degrees |
|---|---|---|---|
| −214 | −78 | −224 | −283 |
| −316 | −71 | −183 | −187 |
| +123 | +15 | +108 | −88 |

As shown in Table 1, a large tensile residual stress did not develop in the axial direction of the surface of the products, and a compressive residual stress developed in the axial direction. As shown in Table 2, a large tensile residual stress in the circumferential direction did not develop in the surface of the products, and a compressive residual stress or a small tensile residual stress developed.

In this mariner, at least the twisted portion 17 has a residual stress of at most +150 MPa and preferably at most +50 MPa. More preferably, substantially all the parts of at least the twisted portion 17 have a residual compressive stress. Therefore, this product has extremely good fatigue properties.

It is not clear why the residual stress in the surface of a product manufactured by working apparatus 0 is a small value of at most +150 MPa which could not be achieved in the past. However, it is conjectured that the distribution of the martensitic transformation in the wall thickness direction is varied by performing heating and cooling by the working apparatus 0.

By using a working apparatus which partially modifies the working apparatus 0 shown in FIG. 7, it is possible to form not only a twisted portion 17 in the body 14 of the hollow members 11-13 but also a bent portion which is bent in an imaginary plane 15*a* or 16*a*. By so doing, it is possible to provide a hollow member having an even more complicated shape.

FIGS. 6A-C are explanatory views showing a hollow member 19 having a first twisted portion 17-1, a second twisted portion 17-2, and a bent portion 18.

The first twisted portion 17-1 and the second twisted portion 17-2 are formed in the body 20 of the hollow member 19. The bent portion 18 is formed between a first portion 21 on one side of the body 20 in the lengthwise direction with a first twisted portion 17-1 as a border and a first portion 22 on one side of the body 20 in the lengthwise direction with the second twisted portion 17-2 as a border.

In this manner, according to the present invention, using an inexpensive and relatively small forming apparatus and simple steps, it is possible to provide a lightweight hollow member having excellent stiffness and impact properties and which is suitable for automotive parts due to having a high strength such as at least 780 MPa and a complicated shape.

The invention claimed is:

1. An automotive part having a hollow metal body, wherein the body is constituted by a single member at least in the lengthwise direction, the body has a flat cross section having at least a portion with a maximum outer dimension and a portion with an outer dimension shorter than the maximum outer dimension, the body has a hot-twisted portion and a non-twisted portion in a portion of its length, the hot-twisted portion having a distribution of a martensitic transformation, the angle of intersection between an imaginary plane including a portion having the maximum outer dimension in a first portion present on one side in the lengthwise direction of the body with the hot-twisted portion as a border and an imaginary plane including a portion with the maximum outer dimension in a second portion present on the other side in the lengthwise direction of the body with the hot-twisted portion as a border is not zero degrees, and the hot-twisted portion is made of steel and has a tensile strength of at least 780 MPa, wherein the ratio of the maximum outer dimension/the shorter outer dimension is at least 1.2 and the angle of intersection is at least 4 degrees;

wherein the automotive part is one that requires bending stiffness when used in an automobile.

2. The automotive part as set forth in claim 1 wherein the body has at least one bent portion.

3. The automotive part as set forth in claim 1 wherein the body has a quench hardened portion locally formed in the lengthwise direction and/or the circumferential direction of the body.

4. The automotive part as set forth in claim 1, wherein the automobile part is one or more of a strength member, a reinforcing member, and a structural member.

* * * * *